US007766632B2

(12) United States Patent
Suh et al.

(10) Patent No.: US 7,766,632 B2
(45) Date of Patent: Aug. 3, 2010

(54) SCROLL COMPRESSOR WITH IMPROVED OIL FLOW PATHWAYS

(75) Inventors: Jeong Hwan Suh, Seoul (KR); Cheol Hwan Kim, Seoul (KR); Dong Koo Shin, Anyang-si (KR)

(73) Assignee: LG Electronics Inc., Seoul (KR)

( * ) Notice: Subject to any disclaimer, the term of this patent is extended or adjusted under 35 U.S.C. 154(b) by 865 days.

(21) Appl. No.: 11/641,027

(22) Filed: Dec. 19, 2006

(65) Prior Publication Data

US 2007/0140885 A1 Jun. 21, 2007

(30) Foreign Application Priority Data

Dec. 20, 2005 (KR) ..... 10-2005-0126242

(51) Int. Cl.
*F04C 18/00* (2006.01)
*F04C 2/00* (2006.01)

(52) U.S. Cl. ..... 418/55.6; 418/55.1; 418/94; 418/97; 418/151; 184/6.18

(58) Field of Classification Search ..... 418/55.1–55.6, 418/57, 151, 88, 94, 97, 270, DIG. 1; 184/6.16–6.18
See application file for complete search history.

(56) References Cited

U.S. PATENT DOCUMENTS

| | | | | |
|---|---|---|---|---|
| 5,439,361 | A * | 8/1995 | Reynolds et al. | 418/55.6 |
| 5,591,018 | A * | 1/1997 | Takeuchi et al. | 418/55.6 |
| 5,775,120 | A | 7/1998 | Inazuka et al. | |
| 5,775,123 | A | 7/1998 | Wakayama et al. | |
| 5,947,373 | A | 9/1999 | Saito et al. | |
| 6,182,460 | B1 | 2/2001 | Hernandez et al. | |
| 6,287,099 | B1 | 9/2001 | Chang, II et al. | |
| 6,374,492 | B1 | 4/2002 | Myung et al. | |
| 6,412,298 | B2 | 7/2002 | Kang et al. | |
| 6,588,228 | B2 | 7/2003 | Choi | |
| 6,659,735 | B2 | 12/2003 | Kim | |
| 6,685,441 | B2 | 2/2004 | Nam | |
| 6,695,600 | B2 | 2/2004 | Koo et al. | |
| 6,772,601 | B1 | 8/2004 | Davis et al. | |
| 6,868,681 | B2 | 3/2005 | Woo et al. | |
| 6,951,628 | B2 | 10/2005 | Eidam et al. | |

(Continued)

FOREIGN PATENT DOCUMENTS

| | | |
|---|---|---|
| JP | 02-227586 | 9/1990 |

(Continued)

OTHER PUBLICATIONS

JP 07-197893 English Translation.*

(Continued)

*Primary Examiner*—Theresa Trieu
(74) *Attorney, Agent, or Firm*—Ked & Associates LLP

(57) ABSTRACT

A scroll-type compressor includes a compression unit, a main frame supporting the compression unit, and a driving shaft having an oil supply path. The oil supply path is located eccentrically with the driving shaft and an upper part of the driving shaft is supported by the main frame. The compressor also has a motor for rotating the driving shaft, an oil cap located on an upper side of a rotor of the motor, and a balance member to compensate the driving shaft.

22 Claims, 8 Drawing Sheets

U.S. PATENT DOCUMENTS

| | | | | |
|---|---|---|---|---|
| 6,955,064 | B2 | 10/2005 | Lee et al. | |
| 6,962,058 | B2 | 11/2005 | Kim et al. | |
| 7,032,404 | B2 | 4/2006 | Kim et al. | |
| 7,036,331 | B2 | 5/2006 | Kim | |
| 7,055,338 | B2 | 6/2006 | Ergarac et al. | |
| 7,082,776 | B2 | 8/2006 | Shin | |
| 7,114,345 | B2 | 10/2006 | Kim et al. | |
| 7,121,106 | B2 | 10/2006 | Jung et al. | |
| 7,384,250 | B2 * | 6/2008 | Shin et al. | 418/55.6 |

FOREIGN PATENT DOCUMENTS

| | | | |
|---|---|---|---|
| JP | 07197893 | A * | 8/1995 |
| JP | 11182471 | A * | 7/1999 |
| JP | 2003293955 | | 10/2003 |
| JP | 2003293955 | A * | 10/2003 |
| JP | 2004316590 | | 11/2004 |
| JP | 2005188516 | | 7/2005 |

OTHER PUBLICATIONS

JP 11-182471 English Translation.*
Japanese Office Action dated Aug. 17, 2009.

* cited by examiner

- PRIOR ART -

SCROLL COMPRESSOR WITH IMPROVED OIL FLOW PATHWAYS

BACKGROUND

1. Field

One or more embodiments described herein relate to supplying oil for lubricating moving parts.

2. Background

A scroll-type compressor compresses a low-temperature, low-pressure refrigerant into a high-temperature, high-pressure refrigerant. In order to effectively perform this function, various parts of the compressor must be lubricated. These parts include a motor for rotating a drive shaft that is ultimately used to compress and move oil through the compressor. In some compressors, the motor has certain structural features that may weaken the strength of its rotor or otherwise adversely affect stable operation of the compressor.

BRIEF DESCRIPTION OF THE DRAWINGS

The embodiments will be described in detail with reference to the following drawings, in which like reference numerals refer to like elements.

DETAILED DESCRIPTION

A high-pressure-type scroll compressor operates to compress a mixture of refrigerant gas and oil based on the rotational movement of an orbiting scroll. The compressed mixture then flows to a motor along a discharge path. The oil in the gas flowing towards the motor then descends to cool the motor. The descending oil is then stored in an oil sump located at a bottom part of the compressor. The refrigerant is then discharged out of the compressor through a discharge pipe.

As previously indicated, the high-pressure refrigerant gas includes oil. In order to achieve a certain capacity of the compressor, it maybe desirable for the amount of oil discharged out of the compressor to be minimized, as the oil in the refrigerant gas is separated when it passes the motor. One method to minimize the oil circulation rate involves separating the oil from the discharge gas along an oil supply path, located on the rotor, based on rotation of the rotor.

Figure 1:
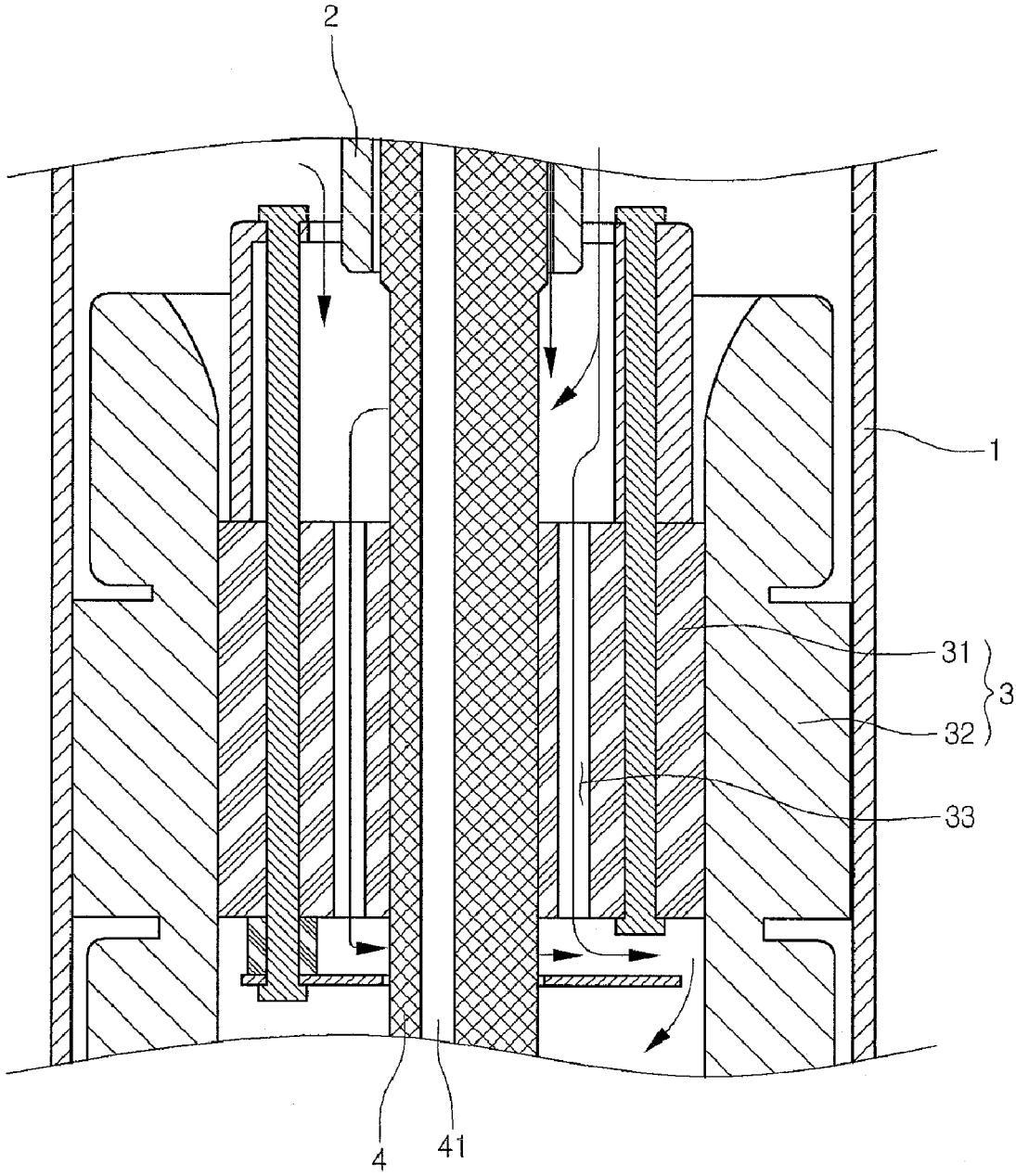
FIG. 1 is a diagram showing a cross-sectional view of an oil supply path in one type of high-pressure-type scroll compressor.

FIG. 1 shows an oil supply path in a high-pressure-type scroll compressor. The compressor includes a housing 1, a motor 3 located on an inner part of the housing, a driving shaft 4 passing through a center part of the motor, and a main frame 2 which supports an upper end part of the driving shaft.

The motor is formed from a rotor 31 and stator 32. The driving shaft passes through a center of the rotor where several oil descent holes 33 are formed, and the stator is mounted on an outer circumferential surface of the rotor. In addition, a compression unit for compressing the refrigerant is mounted on the upper part of the main frame 2. An oil supply path 41 is also formed on the inner side of the driving shaft.

In operation, a mixture of refrigerant gas and oil, which have been compressed to high temperature and pressure by the compression unit, is discharged through an outlet. The oil is discharged into an inner part of the housing on which the motor is mounted. The oil stored in the bottom of housing ascends through oil supply path 41 by centrifugal force generated by rotation of the driving shaft. The ascending oil lubricates as it spread on the contact parts of the compression unit and the main frame.

The oil in the high-temperature, high-pressure mixture of refrigerant gas and oil which is discharged from the compression unit refrigerates motor 3 as it descends through oil descent hole 33 on rotor 31. The oil passing through the descent hole flows into an oil sump formed on a lower side of the housing. A portion of the discharged oil then flows down through a gap between the stator and rotor, and then flows down through the supply path between the stator and housing.

The scroll-type compressor of FIG. 1 has several problems. First, the plurality of oil descent holes on the rotor (used for cooling the motor) tends to weaken the strength of the rotor. Second, the number and size of the oil descent holes limits magnetic resistance. Third, proper functioning of the compressor may be impossible as the stator or rotor is damaged by deformation or abrasive forces and as a result of the strength of the rotor being weakened.

Figure 2:
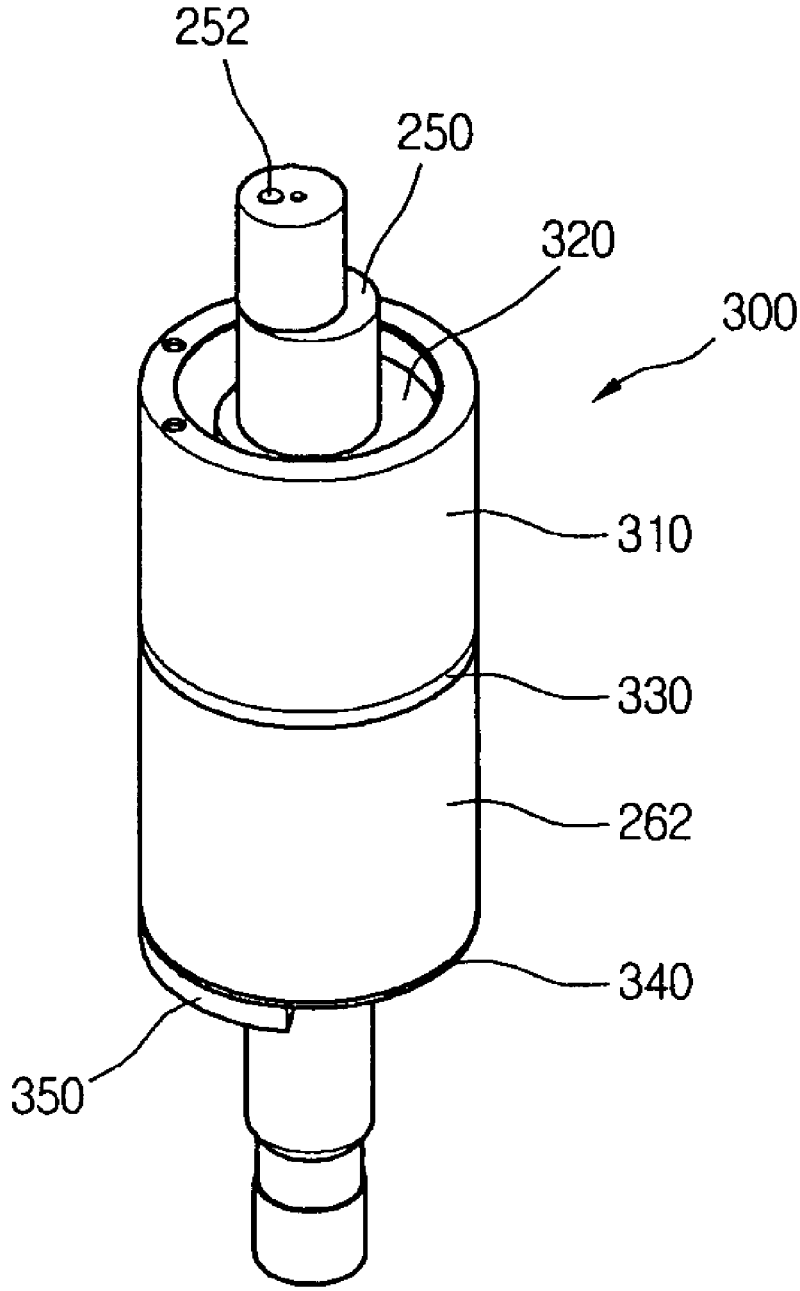
FIG. 2 is a diagram showing one embodiment of a driving unit assembly included in another type of scroll compressor.
Figure 3:
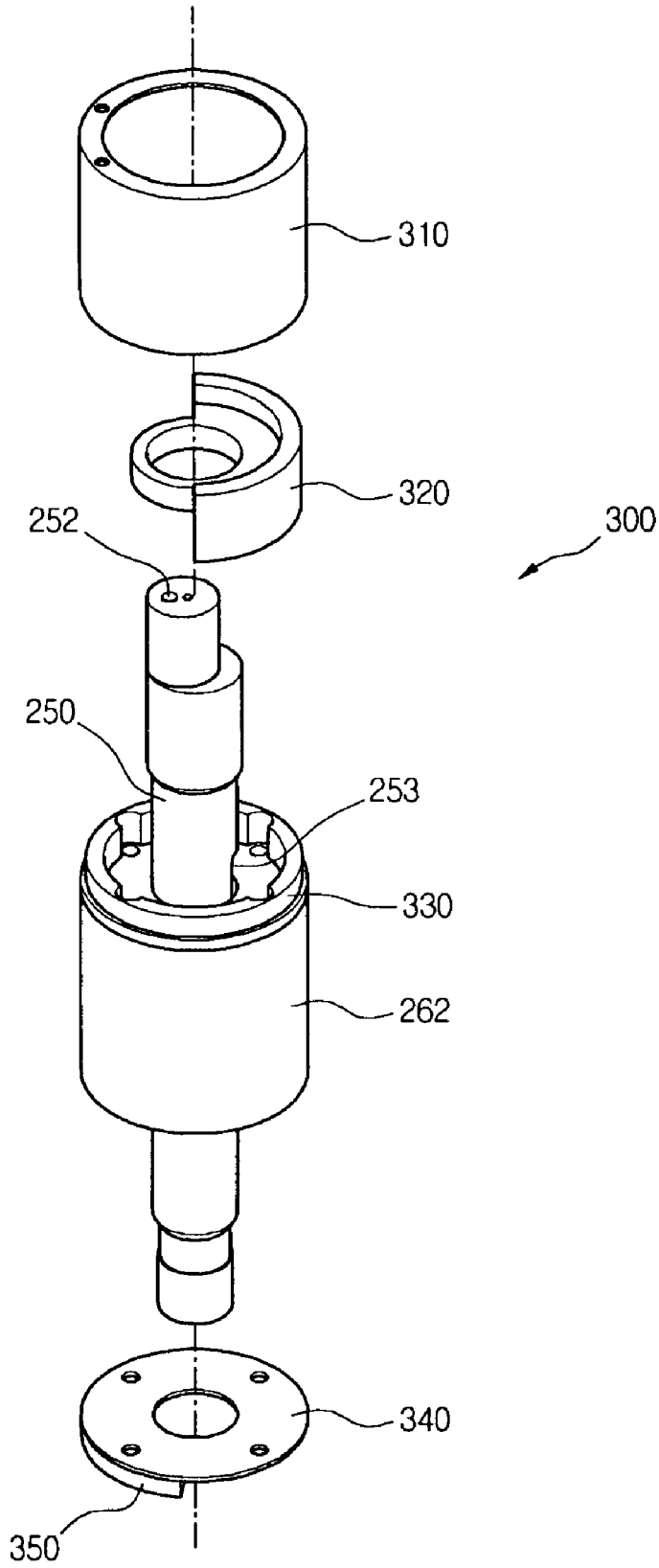
FIG. 3 is a diagram showing a disassembled view of the driving unit assembly of FIG. 2.

FIG. 2 shows one embodiment of a driving unit assembly 300 that may be included in another type of scroll compressor, and FIG. 3 shows a disassembled view of this driving unit assembly. The driving unit assembly includes a driving shaft 250 which rotates as a motor starts rotating. A rotor 262 of the motor is located along an outer circumferential surface of the driving shaft. The driving unit assembly further includes an upper end ring 330 which is united with an upper side of the rotor, and an oil cap 310 located on the upper side of the upper end ring.

The assembly also includes an upper balance 320 located in an inner part of oil cap 310. The upper balance may rotate with the driving shaft in a one-body structure, although this is not a necessity. A lower end ring 340 is located on the lower side of rotor 262 and a lower balance 350 is located on the lower side of the lower end ring 340.

An oil supply path 252 is eccentrically formed towards a center of the driving shaft. The oil supply path allows oil to flow as it ascends from a lower location. The oil supply path is formed a predetermined distance from a center of the driving shaft.

A recession part 253, having a predetermined width and length and recessed to a predetermined thickness, is formed on an outer circumferential surface of the driving shaft. The recession part allows a refrigerant to flow along a predetermined course as will be described in greater detail below.

The upper balance 320 is located a predetermined distance away from upper end ring 330 and rotates with the driving shaft 250, preferably, in a one-body structure. An upper part of the driving shaft is eccentrically formed at the center of rotation of the driving shaft, and a center of gravity of the driving shaft is inclined in the eccentric direction.

To compensate for the center of gravity of the driving shaft, upper balance 320 is formed to provide a load in the opposite direction of the eccentric direction of the driving shaft. Also, lower balance 350 may be located on an opposite side of the upper balance 320 to provide stability of rotation of the driving shaft. Oil cap 310, located on an upper side of rotor 262, plugs a leak of the oil included in a gas passed through a main frame (as described later) in an inner part of compressor.

Figure 5:
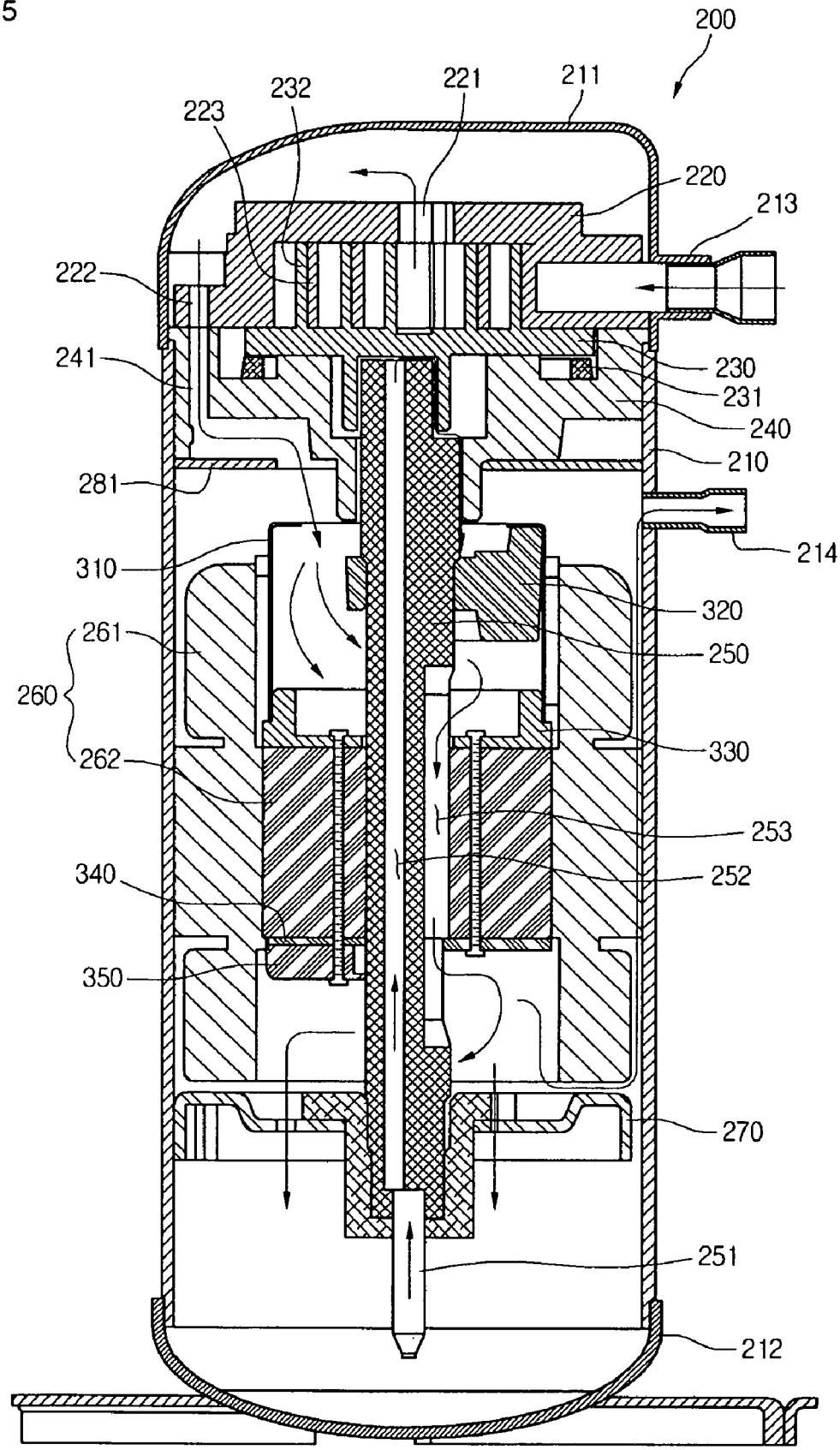
FIG. 5 is a diagram showing a cross-sectional view of the scroll compressor.

The outer circumferential surface of rotor 262 may be rounded by stator 261 (see FIG. 5). That is, stator 261 is located in the outer circumferential surface of rotor 262, and the rotor is rotated by interaction of a magnetic field generated when power is provided to the stator. More specifically, a rotating magnetic field may be formed based on multi-phase source of alternating current applied to the stator. Here, an induced current is generated by the rotating magnetic field generated at the rotor, and a stating magnetic field is formed on the rotor. The rotor starts rotating by starting torque obtained from the magnetic fields. A centrifugal force is generated as the driving shaft is rotated by the rotation of the rotor. The force becomes a power source which operates to lift the fluid stored in the lower side of the scroll compressor.

The oil cap 310 can also provide a path for fluid discharged to the lower side of the main frame. The fluid moved to an inner part of the oil cap may flow downward along the recession part 253 formed on the driving shaft.

In this embodiment, the reliability of the driving unit assembly may be improved by upper balance 320 being mounted on the driving shaft. Furthermore, manufacturing costs may be reduced and reliability of operation of the drive unit assembly may be elevated by the one-body formation of lower end ring 340 and lower balance 350.

Also, a dispersion direction of the oil and refrigerant can be properly controlled based on the shape, size, and extended direction of lower balance 350. The center of gravity of the driving shaft may be compensated for by the lower balance.

Figure 4:
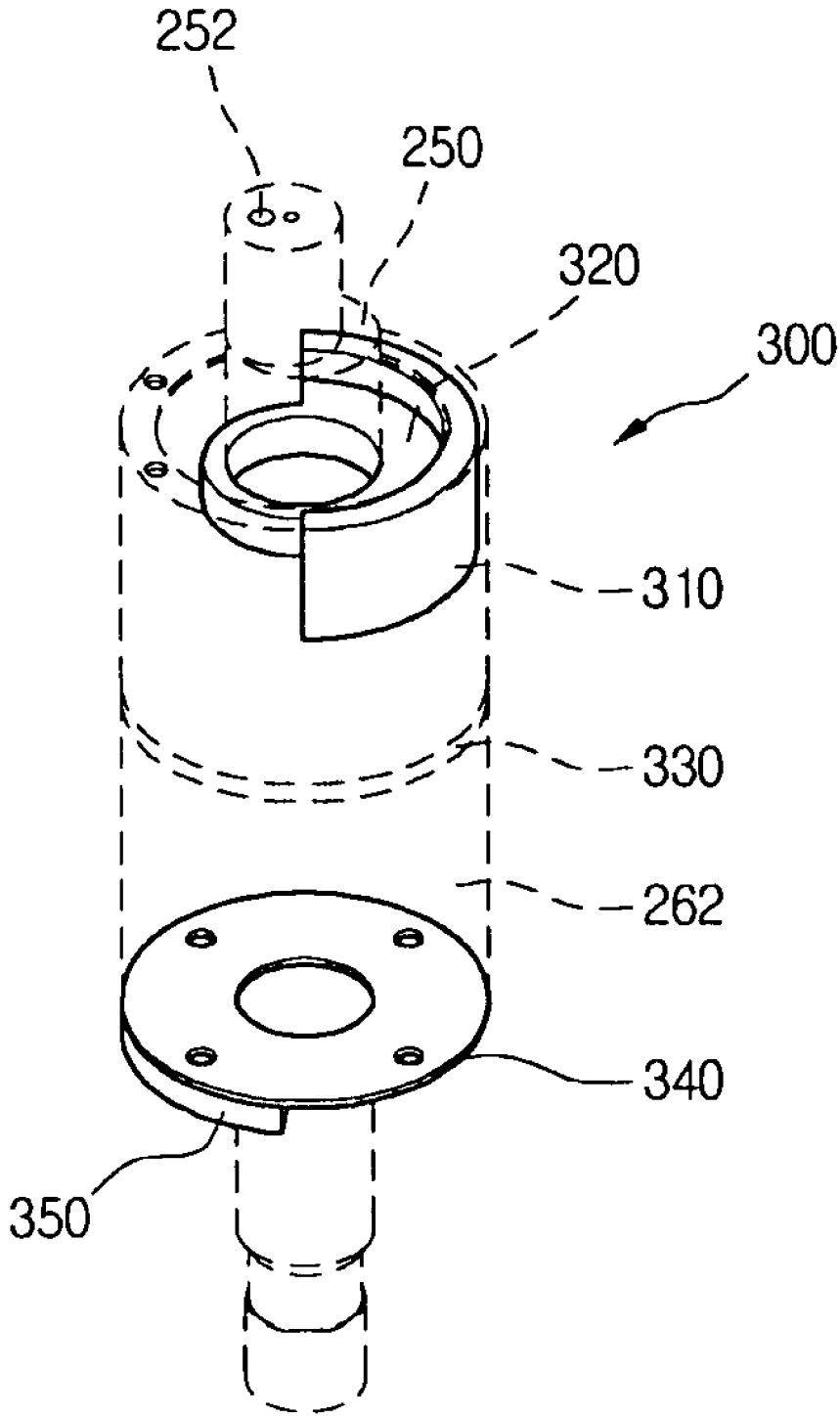
FIG. 4 is a diagram showing a balance member that may be included in the scroll compressor.

FIG. 4 shows an image of the balance member, where upper balance 320 is formed in an inner side of oil cap 310 and lower balance 350 is formed on the lower side of upper balance 320. The upper and lower balances compensate the eccentric load of the driving shaft to provide for stable rotation of the driving shaft.

As the rotor rotates by electromagnetic forces, the revolving action of an orbiting scroll may not progress smoothly or friction can be generated by equipment around the rotor, if the driving shaft is rotated in the eccentric structure. The upper and lower balances may therefore operate to compensate the eccentric load of the driving shaft.

The upper balance may be located to apply a load in an opposite direction of the eccentric direction of the driving shaft. The lower balance may have a smaller load than the load of the upper balance and may be located to deliver a load in the opposite direction of the load of the upper balance.

FIG. 5 shows a more detailed view of the scroll compressor including the aforementioned features. As shown, the compressor includes housing 210, discharge cover 211 having a refrigerant suction pipe 213 located on an upper side of the housing for allowing an in-flow of refrigerant to pass, and base cover 212 located on a lower side of the housing for storing oil.

The scroll compressor 200 further includes motor 260, driving shaft 250, and mainframe 240. The motor generates rotary power as set in an inner part of the housing. The driving shaft rotates as it passes through a center part of the motor. The main frame 240 supports an upper part of the driving shaft, a base frame 270 supports a lower side of the driving shaft, and a compression unit is included for compressing refrigerant at an upper side of the main frame.

The compression unit includes orbiting scroll 230, an oldham ring 231 leading a revolving movement of the orbiting scroll at a lower side of the orbiting scroll, and fixed scroll 220 having a compressing space at an upper side of the orbiting scroll.

The motor includes a stator 261 located in an inner circumferential surface of the housing and rotor 262 which rotates in an inner part of stator. The driving shaft passes through a center part of the rotor.

Recession part 253 of a predetermined width and depth is formed on the outer circumferential surface of the driving shaft. Oil flows through the recession part. As part of the circumferential surface of the stator is incised by the D-cut process, a supply path for causing a flow of refrigerant gas to ascend is formed. The oil, flowing into an inner part of oil supply path 252, ascends as a result of the centrifugal force generated by rotation of the driving shaft. The oil supply path is formed by an eccentric condition created one way on a center part of the driving shaft.

An oil feeder 251 is coupled to a lower side of the driving shaft, and it rotates preferably in a one-body structure with the driving shaft as it pumps the stored oil to be moved to oil supply path 252. The base frame 270 has a hole to allow the oil to flow to a lower side of the oil compressor.

The scroll-type compressor further includes upper end ring 330 which is united with the upper side of the rotor, upper balance 320 mounted on the driving shaft isolated upwards a predetermined distance from the upper end ring 330, and oil cap 310 united with the upper side of the upper end ring 330 and having upper balance 320 in the inner part.

Also included is lower end ring 340 united on the lower side of the rotor and lower balance 350 united on the lower side of end ring 340. Many of the aforementioned features of the scroll compressor are also shown in FIGS. 2 and 3. Lower end ring 340 and lower balance 350 may be manufactured as separate components, but may also be manufactured as a monolithic structure.

Orbiting scroll wrap 232 having spiral shape is located on an upper part of orbiting scroll 230 of the compression unit. Fixed scroll wrap 223 having spiral shape may be formed on the lower part of fixed scroll 220. The refrigerant flowing between the orbiting scroll wrap and fixed scroll wrap is compressed with at high-pressure by the rotational movement of the orbiting scroll.

Discharge hole 221 is formed on the upper part of fixed scroll 220 to discharge compressed refrigerant/oil. Exhaust hole 222 is formed on a side part of the fixed scroll, and the exhaust hole directs movement of the high-pressured fluid.

Connection hole 241, coupled to the exhaust hole, is formed on one side of the main frame. The refrigerant descending through the exhaust hole moves through the connection hole, and the refrigerant that flows out from the connection hole flows into an inner part of the housing.

The mixture of oil and refrigerant at low pressure and temperature flows into refrigerant suction pipe 213. The inhaled mixed fluid is compressed to a high pressure and temperature fluid by the rotational movement of orbiting scroll 230. The high pressure and temperature fluid descends through exhaust hole 222 of the fixed scroll, after being discharging through discharge hole 221 of the fixed scroll.

The fluid passing through the exhaust hole descends through connection hole 241 penetrating on one side of the main frame. The descending mixed fluid moves to the inner part of the housing including the motor. Then, the mixed fluid that moves to the inner part of the housing passes outside the compressor through refrigerant discharge pipe 214.

On the other hand, the oil in the fluid descending through connection hole 241 flows into the inner part of oil cap 310. The oil is then pumped by oil feeder 251, and the pumped oil ascends along oil supply path 252 after descending along the recession part 253 formed on the driving shaft and stored in the base cover.

The oil that ascends along oil supply path 252 ascends up to the upper end of the driving shaft 250, and performs a lubricating operation as it spreads on the contact surface between main frame 240 and orbiting scroll 230. The oil performs this lubricating operation by descending along the minute gap between driving shaft 250 and main frame 240, and then flows into the inner part of the oil cap.

The oil flowing into the inner part of the oil cap descends along recession part 253 formed on the circumferential surface of the driving shaft as it circulates in the inner part of the oil cap. The oil descending along the recession part is restored in the bottom of the compressor through the hole formed on base frame 270.

In this part, a portion of the refrigerant gas in the compressed fluid descending along connection hole 241 is discharged directly through refrigerant discharge pipe 241. The other portion descends after it flows into the inner part of the oil cap 310 with the oil.

The oil descending along recession part 253 circulates in the lower space of the rotor, and ascends along a gap (a predetermined space) formed between the inner surface of the stator and housing. The ascended oil (a mixed fluid) is discharged to outside of the compressor through the refrigerant discharge pipe 214.

Because the recession part on which the oil flows down is formed on the outer circumferential surface of the driving shaft, it is unnecessary to form another hole on the rotor and consequently the amount of discharged oil becomes reduced.

Also, the recession part 253 may be formed on one or more than one of the outer circumferential surfaces of the driving shaft. The fluid descending from the main frame may flow down to the lower side of base frame 270, as the length of the vertical axis of recession part 253 is formed longer than the length of the vertical axis of the rotor.

Furthermore, the refrigerant and mixed fluid discharged through the lower side of main frame 240 are not dispersed everywhere in the inner part of the housing, as oil cap 310 having a predetermined inner space is mounted on the upper side of the rotor.

The oil that ascends along oil supply path 252 of the driving shaft descends after lubricating orbiting scroll 230 and the main frame. Then, the high-pressure, high-temperature oil discharged to the lower side of the main frame is not scattered to the inner circumferential surface of the housing, but is guided to the recession part of the driving shaft without difficulty by the oil cap.

Therefore, the oil circulation rate is reduced and the supply paths of the refrigerant and oil are effectively separated, as the most of the oil guided to the recession part 253 is gathered in the lower side of base frame 270.

One or more embodiments described herein, therefore, may provide a scroll-type compressor which is capable of securing a smooth oil supply path and minimizing the mixing section of the oil and refrigerant, by improving the structure of the oil supply path for cooling the motor The scroll-type compressor may also have improved capacity by maximizing the centrifugation capacity of the oil based on the rotation of the stator.

The scroll-type compressor may also minimize the amount of oil discharged from the compressor and may prevent abrasions of the components of the compressor, or overheating of the compressor, by improving the oil supply path for cooling the motor.

Thus, according to one embodiment, the scroll-type compressor comprises: a compression unit; a main frame supporting the compression unit; a driving shaft having an oil supply path, and the oil supply path located eccentrically in an inner part of the driving shaft, and an upper part of the driving shaft supported by the main frame; a motor having a stator and a rotor for rotating the driving shaft; an oil cap located on an upper side of the rotor; and a balance member wrapping the driving shaft.

It is effective that the mixing section of the oil and refrigerant is minimized as the oil supply path is improved with the scroll compressor.

It is also effective that abrasion of parts in the compressor is reduced and compression capacity is improved, as the amount of the oil flowing out of the compressor during the compression process, is minimized with the improvement in the oil supply path. Through the aforementioned feature, the strength of the rotor may also be reinforced and sufficient magnetic resistance may be achieved. Moreover, a transformation by the weakening of the strength of the rotor does not occur as the formation of the holes for the oil supply path in the inside of the rotor is needless.

Descriptions of scroll compressors and the operation thereof may be found, for example, in U.S. Pat. Nos. 6,695,600, 6,685,441, 6,659,735, and 6,287,099, the contents of which are incorporated herein by reference and which are subject to an obligation of assignment to the same entity.

Although the embodiments described herein relate to scroll compressors for ease of discussion, it is understood that an oil pump as embodied and broadly described herein may be applied to other types of compressors and/or other applications which require fluid pumping. These other types of compressors include but are not limited to different types of scroll compressors, reciprocating compressors, centrifugal compressors, and vane-type compressors.

Figure 6:
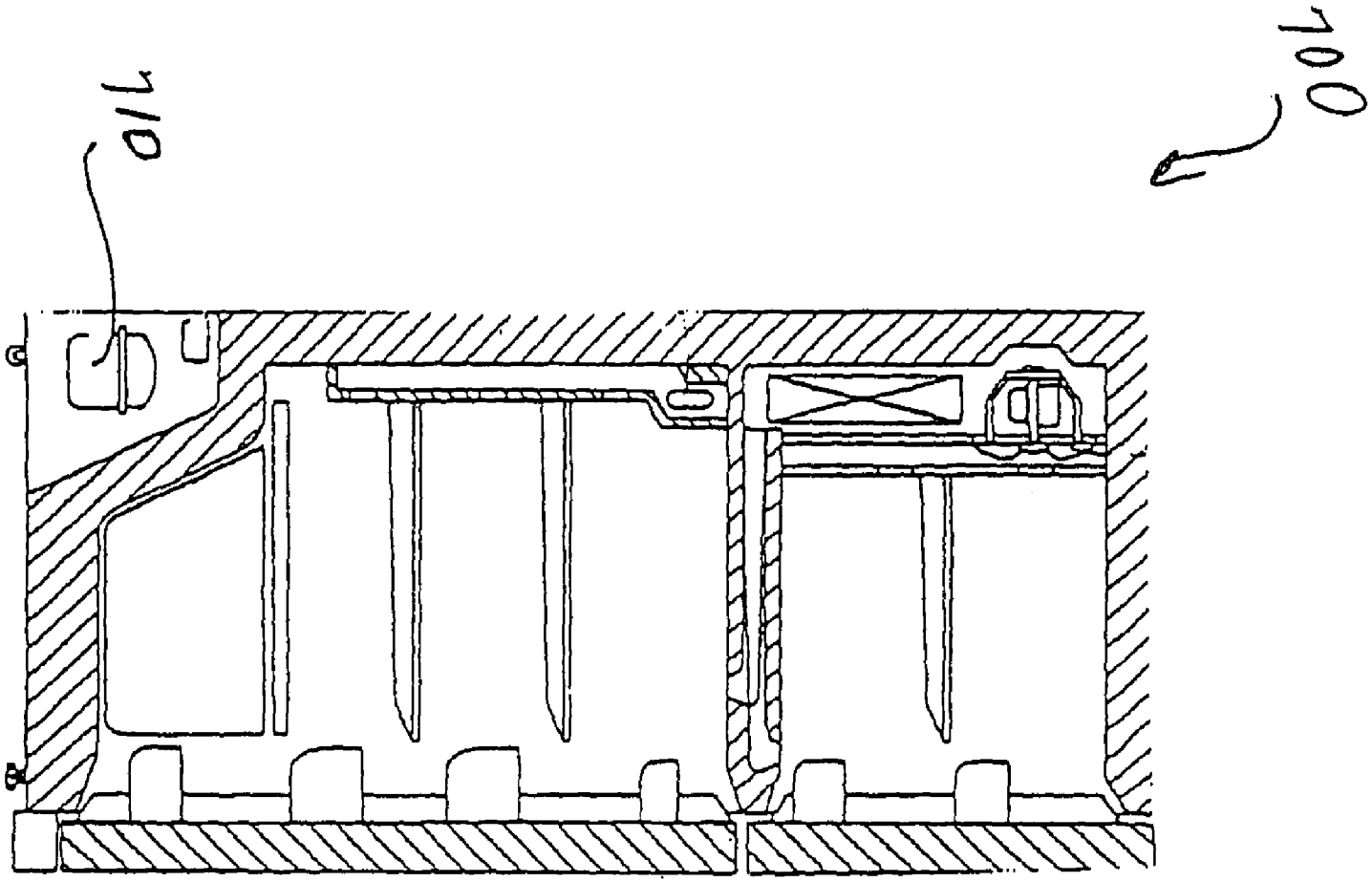
FIGS. 6-8 are diagrams showing exemplary installations of a compressor incorporating an oil pumping assembly as embodied and broadly described herein.

Moreover, a compressor containing the oil pump described herein may have numerous applications in which compression of fluids is required. Such applications may include, for example, air conditioning or refrigeration applications. One such exemplary application is shown in FIG. 6, in which a compressor 710 having an oil pump as described herein is installed in a refrigerator/freezer 700. The installation and functionality of a compressor when embodied within a refrigerator is discussed in detail in U.S. Pat. Nos. 7,082,776, 6,955,064, 7,114,345, 7,055,338, and 6,772,601, the entirety of which are incorporated herein by reference.

Figure 7:
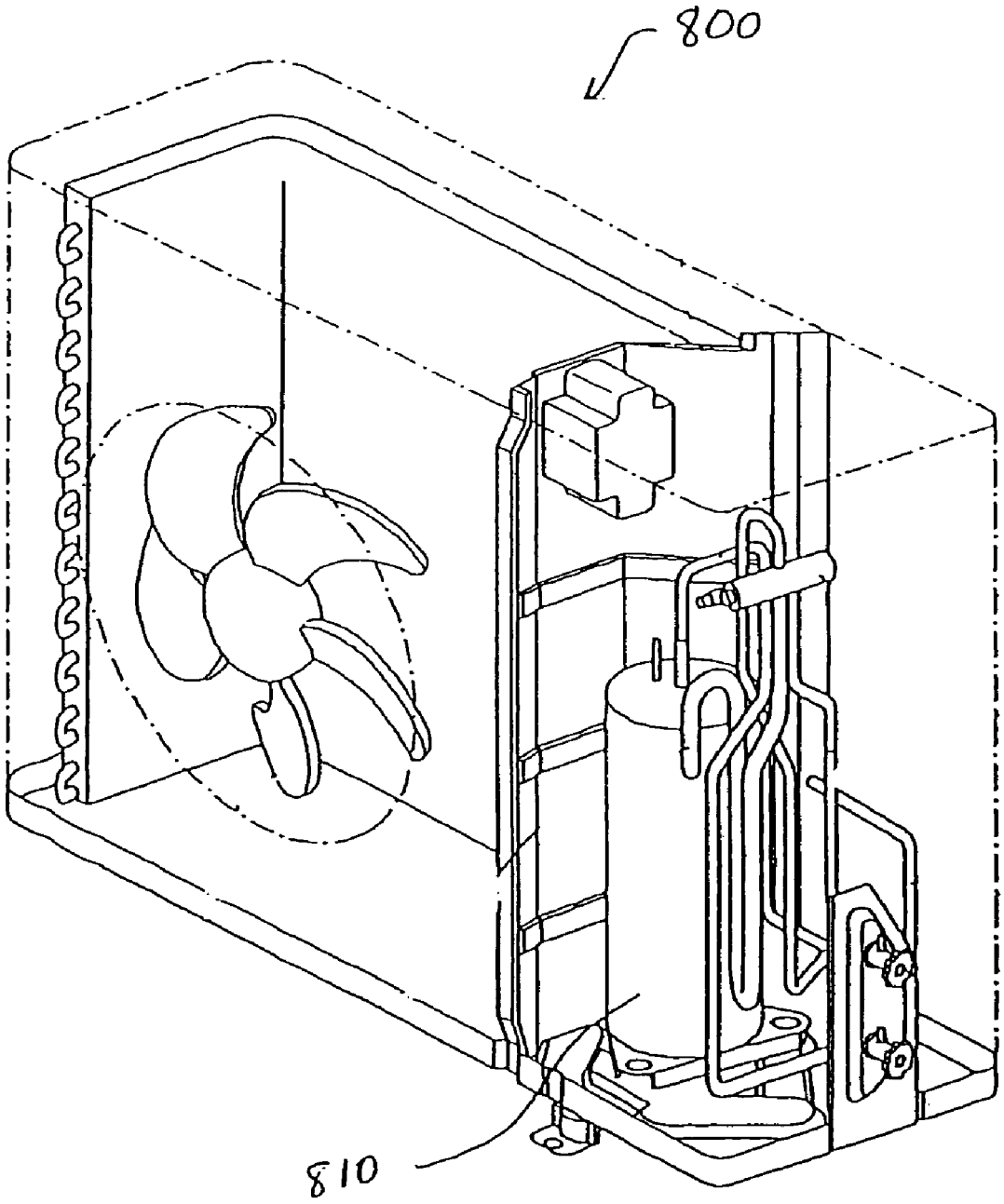

Another exemplary application is shown in FIG. 7, in which a compressor 810 having an oil pumping assembly as described herein is installed in an outdoor unit of an air conditioner 800. The installation and functionality of a compressor when embodied within an outdoor unit of air conditioner is discussed in detail in U.S. Pat. Nos. 7,121,106, 6,868,681, 5,775,120, 6,374,492, 6,962,058, 6,951,628, and 5,947,373, the entirety of which are incorporated herein by reference.

Figure 8:
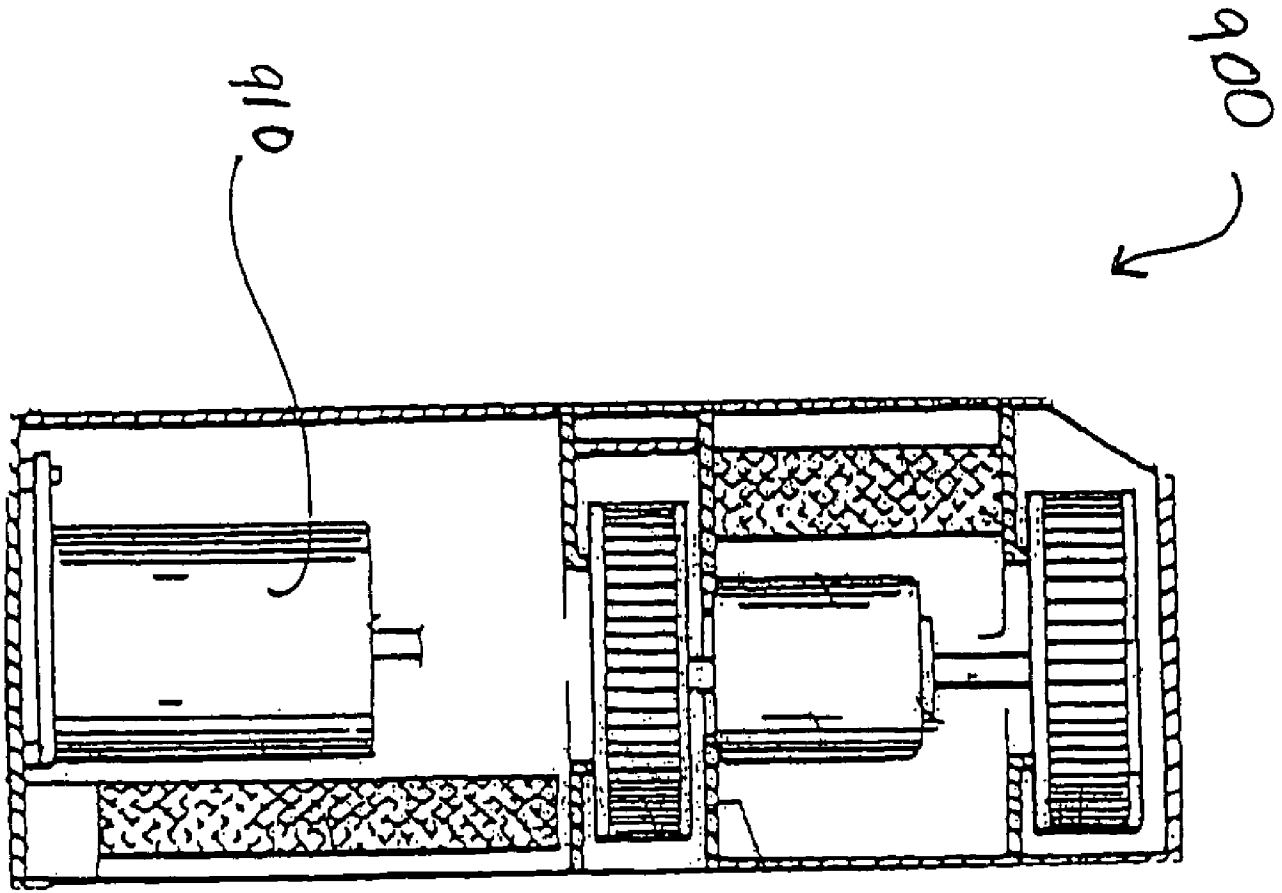

Another application of the compressor containing an oil pump as described herein relates to an integrated air conditioning unit. As shown in FIG. 8, this application includes a compressor 910 having an oil pump as described herein is installed in a single, integrated air conditioning unit 900. The installation and functionality of a compressor when embodied within an outdoor unit of air conditioner is discussed in detail in U.S. Pat. Nos. 7,036,331, 7,032,404, 6,588,228, 6,412,298, 6,182,460, and 5,775,123, the entirety of which are incorporated herein by reference.

Any reference in this specification to "one embodiment," "an exemplary," "example embodiment," "certain embodiment," "alternative embodiment," and the like means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a compression unit;

a main frame coupled to the compression unit;

a driving shaft having an oil supply path located eccentrically in an inner part of the driving shaft, with an upper part of the driving shaft being coupled to the main frame;

a motor having a stator and a rotor for rotating the driving shaft;

an oil cap located on an upper side of the rotor;

a balance member coupled to the driving shaft; and a recession part through which oil flows from the oil cap, the recession part formed on an outer circumferential surface of the driving shaft, wherein at least one portion of the recession part is formed between the driving shaft and the rotor.

2. The scroll compressor of claim 1, wherein the balance member comprises an upper balance formed on an upper side of the driving shaft and a lower balance formed on a lower side of the driving shaft.

3. The scroll compressor of claim 1, wherein the balance member is located in an inner part of the oil cap.

4. The scroll compressor of claim 1, wherein the balance member is located a prescribed distance from the rotor.

5. The scroll compressor of claim 1, further comprising an upper end ring and a lower end ring, the upper end ring being fixed on the upper part surface of the rotor and located between the oil cap and the rotor, the lower end ring being united on a lower side of the rotor.

6. The scroll compressor of claim 5, wherein the balance member includes a lower balance united on the lower end ring in monolithic structure.

7. The scroll compressor of claim 1, wherein a first end of the recession part is located above the motor and a second end of the recession part is located below the motor, and wherein the recession part extends from the first end to the second end at a substantially constant width.

8. The scroll compressor of claim 7, wherein oil flows in the recession part from the first end to the second end along said substantially constant width.

9. The scroll compressor of claim 1, wherein the driving shaft has a first diameter at a point adjacent the motor and a second diameter at a point above or below the motor, and wherein the first diameter is less that the second diameter.

10. The scroll compressor of claim 1, wherein the oil includes a refrigerant.

11. The scroll compressor of claim 1, wherein oil discharged from the compressor passes through the main frame and flows into an inner part of the oil cap, where the oil descends along the recession part as the oil circulates in an inner part of the oil cap.

12. A scroll compressor, comprising:

a compression unit to compress a mixed fluid of refrigerant and oil;

a main frame supporting the compression unit, and having a hole of a predetermined size for movement of the fluid;

a driving shaft supported by the main frame, an upper part of the driving shaft eccentrically formed in a predetermined direction;

a motor formed on an outer side of the driving shaft, the motor having a rotor to rotate the driving shaft;

a balance member for compensating a eccentric load of the driving shaft; and a recession part through which oil flows, the recession part formed on an outer circumferential surface of the driving shaft, wherein the oil descends along the recession part inside the rotor.

13. The scroll compressor of claim 12, wherein the driving shaft has an oil supply path to direct flow of the oil, the oil supply path being placed a predetermined distance from a center of rotation of the driving shaft.

14. The scroll compressor of claim 12, wherein the balance member is composed of an upper balance for compensating an eccentric load of the driving shaft on an upper side of the driving shaft, and a lower balance for compensating of the eccentric load of the driving shaft on a lower side of the driving shaft.

15. The scroll compressor of claim 12, further comprising:

an oil cap located between the main frame and the motor, the oil cap having a space in an inner part.

16. The scroll compressor of claim 15, wherein the balance member is coupled to the outer circumferential surface of the driving shaft, the balance member located in an inner side of the oil cap.

17. The scroll compressor of claim 12, wherein the balance member is formed to have an eccentric load in a specific direction.

18. A scroll compressor comprising:

a compression unit;

a main frame for supporting the compression unit;

a driving shaft supported by the main frame and including an oil supply path formed eccentrically in an inner part of the driving shaft, and a rotor coupled to an outer circumference surface of the driving shaft;

a recession part recessed on an outer circumferential surface of the driving shaft, an upper end of the recession part located over the rotor and a lower end of the recession part located under the rotor for returning oil to a lower space of the rotor;

an oil cap located on an upper side of the rotor; and a balance member coupled to the driving shaft, wherein the balance member includes an upper balance and a lover balance, the upper balance located in an inside of the oil cap and an outer side of the driving shaft being rounded by the upper balance, and the lower balance is located on a lower side of the rotor.

19. The scroll compressor of claim 18, wherein the upper balance is formed a predetermined distance from the rotor.

20. The scroll compressor of claim 8, wherein oil discharged from the compression unit passes through the main frame and flows into an inner part of the oil cap, where the oil descends along the recession part as the oil circulates in an inner part of the oil cap.

21. The scroll compressor of claim 18, wherein the oil cap has a predetermined length and diameter, and has a predetermined size of space in the inner part.

22. A scroll compressor comprising:

a compressor;

a main frame for supporting the compressor;

a driving shaft supported by the main frame and including an oil supply path formed eccentrically in an inner part of the driving shaft, and a rotor coupled to an outer circumference surface of the driving shaft;

a recession part recessed on an outer circumferential surface of the driving shaft for guiding oil to a lower space of the rotor;

an oil cap located on an upper side of the rotor; and a balance member coupled to the driving shaft, wherein the balance member includes an upper balance and a lover balance, the upper balance located in an inside of the oil cap and an outer side of the driving shaft being rounded by the upper balance, and the lower balance is located on a lower side of the rotor, wherein oil discharged from the compressor passes through the main frame and flows into an inner part of the oil cap, where the oil descends along the recession part as the oil circulates in an inner part of the oil cap.

* * * * *